United States Patent [19]

Chou

[11] Patent Number: 5,063,754

[45] Date of Patent: Nov. 12, 1991

[54] INSTANT COOLING CAN

[76] Inventor: Tien-Fa Chou, No. 117, Lane San Ting, Shui Li Hsiang, Nan Tou Hsien, Taiwan

[21] Appl. No.: 605,336

[22] Filed: Oct. 30, 1990

[51] Int. Cl.[5] ..... F17C 13/00

[52] U.S. Cl. ..... 62/457.9; 62/457.1; 62/294

[58] Field of Search ..... 62/293, 294, 394, 457.1, 62/457.9, 271

[56] References Cited

U.S. PATENT DOCUMENTS 3,320,767 5/1967 Whalen ..... 62/294

4,361,013 11/1982 Seele ..... 62/294

*Primary Examiner*—Albert J. Makay

*Assistant Examiner*—John Sollecito

*Attorney, Agent, or Firm*—Varndell Legal Group

[57] ABSTRACT

An instant cooling can, comprising an inner container received inside an outer container for containing beverage or foods. An instant cooling media is received inside a vacuum space between the outer container and the inner container. A ball is fastened in the neck portion of the can to seal the vacuum space. The ball is removed from its position permitting outside air to flow into the vacuum space to cause the instant cooling media to generate cooling gas for mixing with the beverage or foods contained inside the inner container so as to instantly drop the temperature of the beverage or foods.

4 Claims, 5 Drawing Sheets

INSTANT COOLING CAN

BACKGROUND OF THE INVENTION

The present invention relates to a kind of instant cooling can which contains an instant cooling mediate to drop the temperature of the beverage or foods contained therein once the cap is opened.

It is commonly known that soda drinks and beer will produce more delicious taste if stored in refrigerator or ice-box, or cooled before service. If beverage is not stored in refrigerator or ice-box for a certain length of time or mixed with ice cubes, it can not be instantly cooled down. However, ice-box or refrigerator is inconvenient to carry with oneself while one goes outdoors.

SUMMARY OF THE INVENTION

The present invention has been accomplished under the circumstances in view. It is therefore an object of the present invention to provide an instant cooling can for containing beverage, which has means to instantly cool down the beverage when it is opened. It is another object of the present invention to provide an instant cooling can which is convenient for carry with oneself.

BRIEF DESCRIPTION OF THE DRAWINGS

The present invention will now be described by way of examples, with reference to the annexed drawings, in which.

DETAILED DESCRIPTION OF THE PREFERRED EMBODIMENTS

Figure 1A:
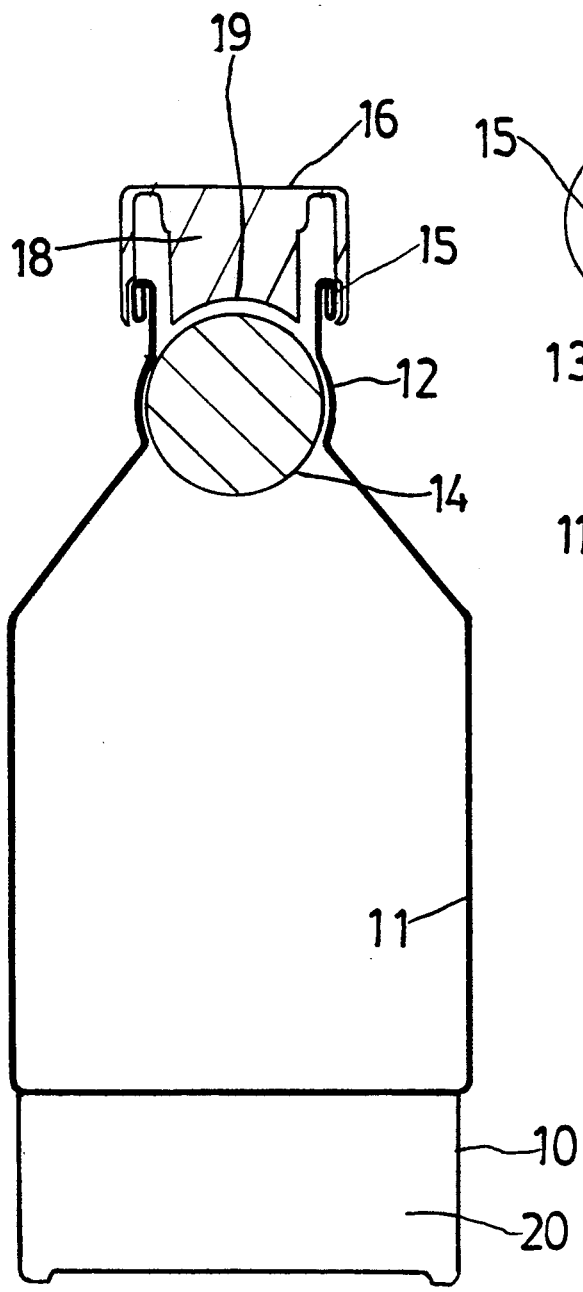
FIGS. 1A-1D are schematic sectional views of a first embodiment of instant cooling can according to the present invention.
Figure 1B:
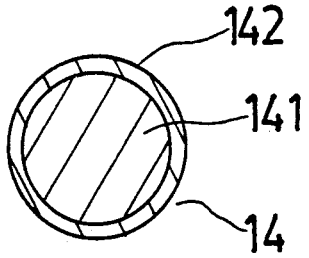
Figure 1C:
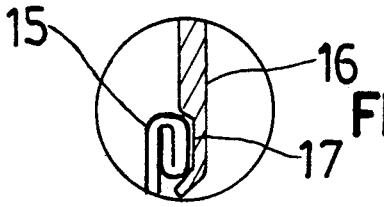
Figure 1D:
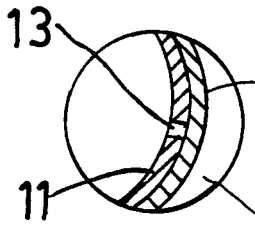
Figure 2B:
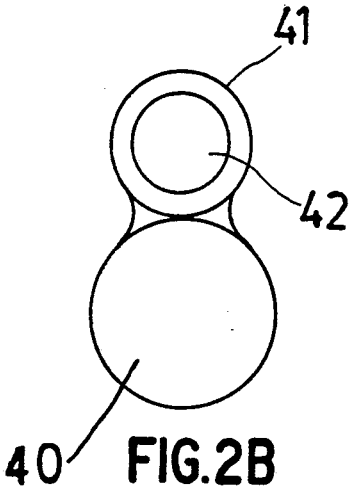
FIGS. 2A-2D are schematic sectional views of a second embodiment of instant cooling can according to the present invention.
Figure 2C:
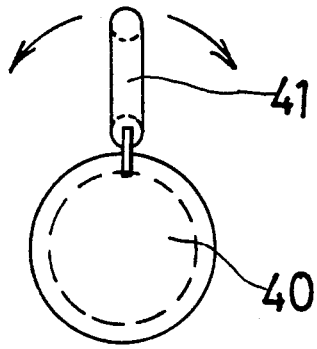
Figure 2A:
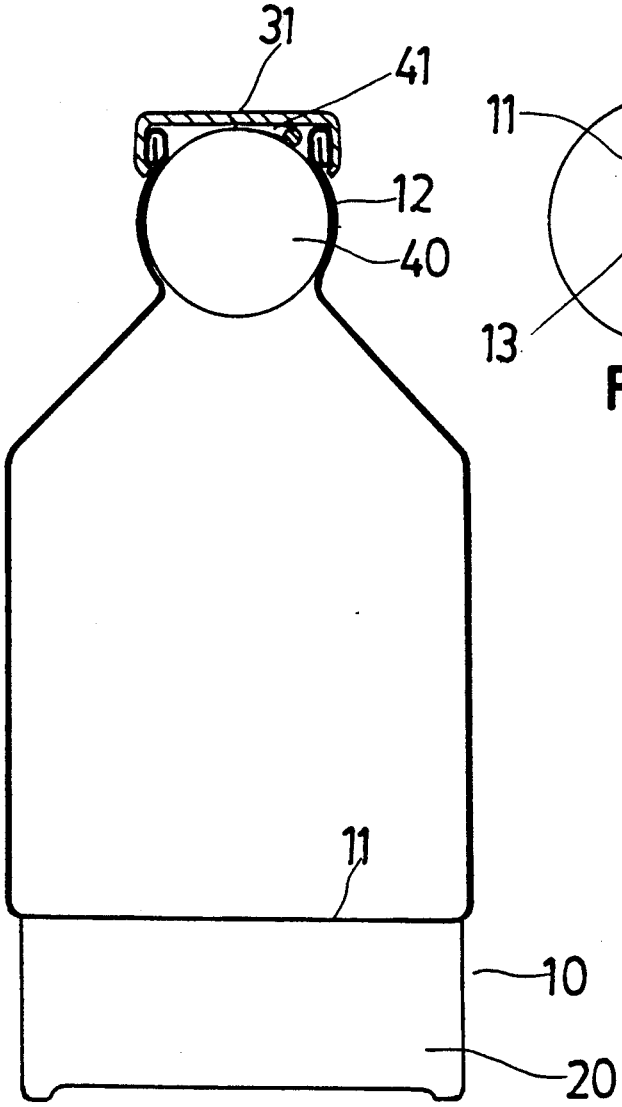
Figure 2D:
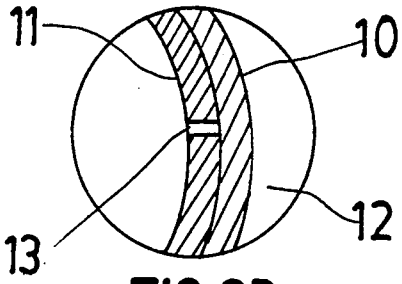

Referring to FIGS. 1A-1D, there is illustrated an instant cooling can embodying the present invention and generally comprised of an inner container 11 received inside an outer container 10. The inner container 11 is provided for containing beverage or foods and designed in such a size that a very small gap is maintained between its outer wall and the inner wall of the outer container 10 permitting capillary effect to perform therebetween, and a receiving space is maintained between its bottom end and the bottom end of the outer container 10 for tightly keeping an instant cooling media 20. An instant cooling media 20 can be a dry ice or fluorocarbon compound. The inner and outer containers 11 and 10 have each an opening at the top and disposed with one inside the other. The top edge of the opening of the inner container 11 is fixedly connected with the top edge of the opening of the outer container 10 and tightly sealed by glue to form a neck portion 12. The top edge of the neck portion 12 is further processed into a folded edge 15. During manufacturing process, a plurality of air holes 13 are made on the inner container 11 around the neck portion 12 area, and a ball 14 is fastened in the neck portion 12 to seal the air holes 13.

According to the present invention, a ball 14 may be made of glass, silicon rubber, plastic rubber and any suitable resilient material, or comprised of a rigid core 141 made of glass or plastic material covered with an outer layer 142 of silicon rubber or any suitable resilient material. Further, there is provided a cap 16 mounted on the top opening of the can. The cap 16 has a recessed portion 17 around the vertical inner wall thereof at the bottom for engaging with the folded edge 15 of the instant cooling can, and a cylindrical cork 18 internally disposed at the center and inserted in the top opening of the instant cooling can. The cylindrical cork 18 of the cap 16 has a spherical surface 19 at the bottom and closely attached to the ball 14.

The operation of the present invention is outlined hereinafter. Hit the cap 16 to push the cylindrical cork 18 to squeeze the ball 14 to drop inside the inner container 11 permitting stream of air to pass through the air holes 13 into the inner space of the outer container 10 to further cause the instant cooling media 20 to evaporate. The evaporated gas from the instant cooling media 20 immediately flows through the air holes 13 into the inner space of the inner container 11. The instant cooling can is then gently shaken, permitting the evaporated gas to mix with the beverage contained inside the inner container 11. At the same time, the cap 16 may be pushed by the saturated gas to break away from the can or removed from the can with fingers, and the beverage inside the inner container 11 is cooled down for drink.

Figure 3A:
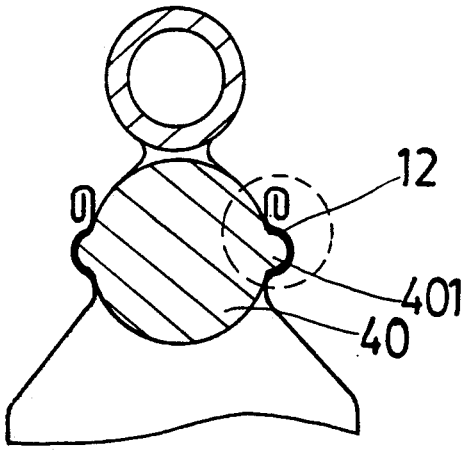
FIGS. 3A through 6B illustrate various alternate forms of sealing ball according to the present invention.
Figure 3B:
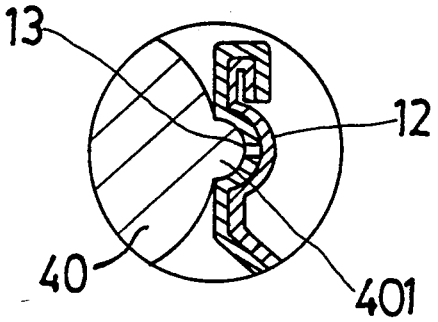
Figure 4A:
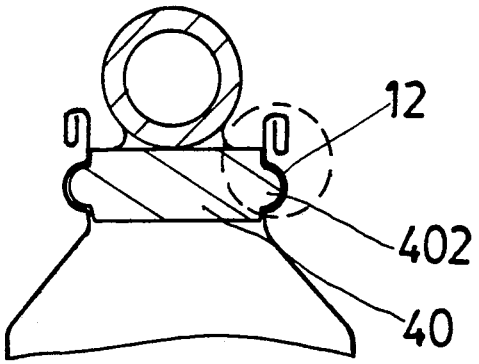
Figure 4B:
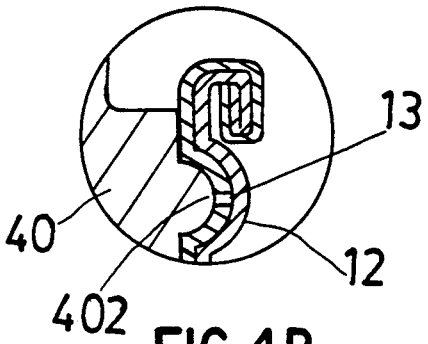
Figure 5A:
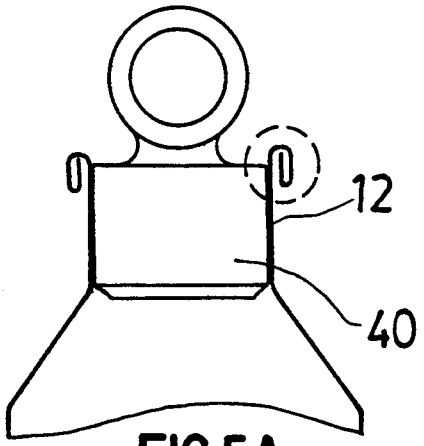
Figure 5B:
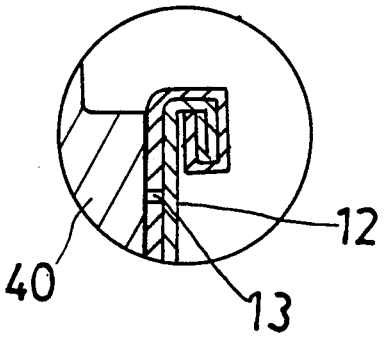
Figure 6A:
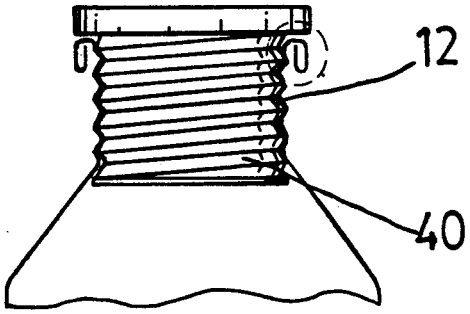
Figure 6B:
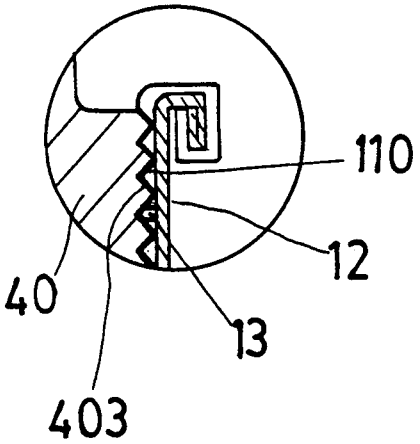

Referring to FIGS. 2A-2D, therein illustrated is an alternate form of the present invention. In this embodiment, the structure of the inner container 11, the outer container 10 and the instant cooling media 20 is remained unchanged. The only change is on the cap and the sealing ball. As illustrated, the ball 40 is incorporated with a pull ring 41 and covered by a substantially U-shaped cap 31. The cap 31 is designed in such a manner that it can be conveniently removed from the neck portion 12 of the can. After the cap 31 is removed from the neck portion 12, use a finger to insert through the hole 42 defined in the pull ring 41 and then pull the ball 40 out of the can, permitting the instant cooling media 20 to be caused to evaporate. Thus, evaporated cooling gas from the instant cooling media 20 immediately flows into the inner container 11 to mix up with the beverage contained therein. Further, the ball 40 may be variously embodied as showing in FIGS. 3A, 3B, 4A, 4B, 5A, 5B, 6A and 6B. In FIGS. 3A and 3B, the ball 40 has a circular projection 401 at the middle and fastened in a circular recess on the inner wall of the neck portion 12 to seal the air holes 13 thereon. In FIGS. 4A and 4B, the ball 40 is designed in a flat structure having a circular projection 402 horizontally projecting therefrom at the middle for sealing the air holes 13 on the circular recess of the neck portion 12. In FIGS. 5A and 5B, the ball 40 is designed in a cylindrical structure with its vertical outer wall tightly engaged with the inner wall of the neck portion 12 to seal the air holes 13. In FIGS. 6A and 6B, the ball is covered with rubber, silicon rubber, plastic or other suitable resilient material with outer thread 403 made thereon for engaging with the inner thread 110 made on the neck portion 12 and simultaneously sealing the air holes 13.

Figure 7A:
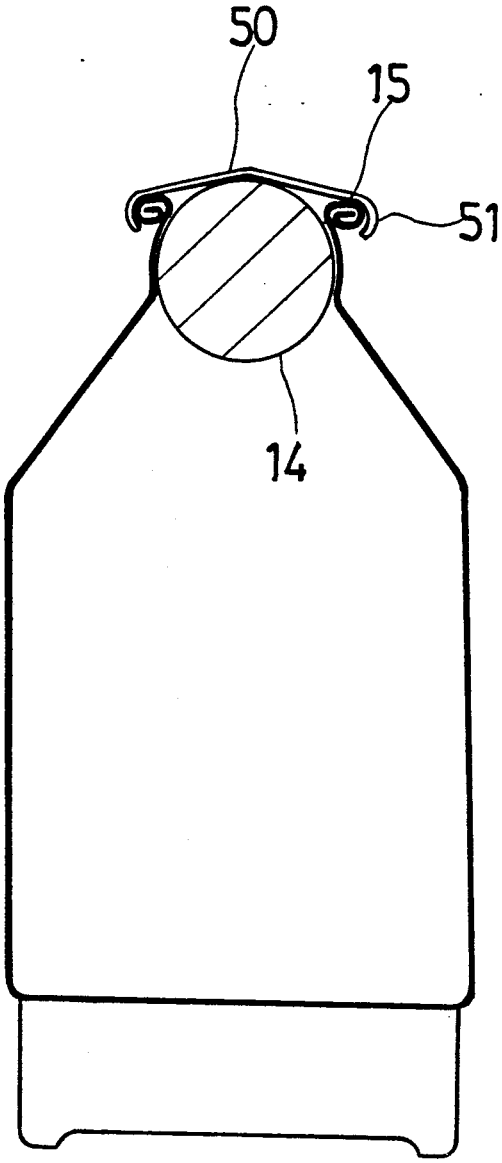
FIGS. 7A and 7B are schematic sectional views of a third embodiment of instant cooling can according to the present invention.
Figure 7B:
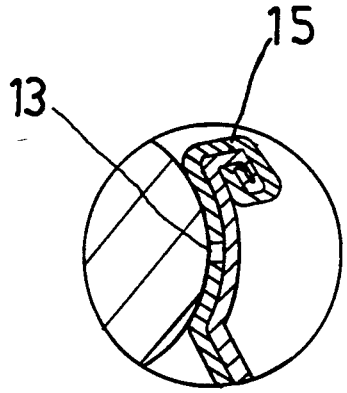

Referring to FIGS. 7A and 7B, there is illustrated still another alternate form of the present invention. In this embodiment, the structure change is made on the cap. As illustrated, the cap 50 has a circular retaining edge 51 extending downward from a substantially domed roof for engaging with the top folded edge 15 of the neck portion of the can. After the cap 50 is removed from the neck portion of the can, the ball 14 can be directly squeezed into the inner container by pressure force to let air pass through the vent holes 13.

I claim:

1. An instant cooling can, comprising an inner container received in and isolated from an outer container for containing beverage or foods, said outer container having contained therein an instant cooling media isolated from said inner container, said inner and outer container having each a bottle neck incorporated with each other and covered with a cap, said inner container having a plurality of air holes made on its bottle neck for passing therethrough of air, and a sealing means fastened in said neck portion to seal said air holes, and characterized in that said sealing means can be moved away from said air holes after said cap is removed from said neck portion, permitting outside air to flow through said air hole into said outer container to cause said instant cooling media to generate cooling gas for mixing with the beverage or foods contained inside said inner container.

2. The instant cooling can of claim 1, wherein said instant cooling media can be a dry ice or fluorocarbon compound.

3. The instant cooling can of claim 1, wherein said sealing means can be made of glass, silicon rubber, resilient plastic or rubber material, or comprised of a rigid core made of glass or plastic material and covered with an outer layer of silicon rubber, rubber or resilient plastics, and designed in round, round-like, cylindrical or screw-like shape.

4. The instant cooling can of claim 1, wherein said seal means is incorporated with a pull ring through which it can be pulled away from said air holes.

* * * * *